United States Patent [19]

Carey, Jr. et al.

[11] Patent Number: 4,751,755

[45] Date of Patent: Jun. 21, 1988

[54] PATIENT TROLLEY WITH IMPROVED TILTABLE BACKREST

[75] Inventors: John S. Carey, Jr., Crofton; Frederick G. McNab, III, Cockeysville, both of Md.

[73] Assignee: Siemens Medical Systems, Inc., Iselin, N.J.

[21] Appl. No.: 940,696

[22] Filed: Dec. 11, 1986

Related U.S. Application Data

[63] Continuation-in-part of Ser. No. 121,546, Feb. 14, 1980, Pat. No. 4,667,354.

[51] Int. Cl.[4] ..... A61G 7/00

[52] U.S. Cl. ..... 5/72; 5/60; 74/501 R; 74/502

[58] Field of Search ..... 5/72, 60, 71, 70; 74/501 R, 502, 501.5 R, 501.5 M

[56] References Cited

U.S. PATENT DOCUMENTS

| | | | |
|---|---|---|---|
| 2,386,767 | 10/1945 | Arens | 74/502 |
| 2,788,529 | 4/1957 | Moritzacky et al. | 5/72 |
| 4,489,449 | 12/1984 | Failor et al. | 5/86 |
| 4,584,728 | 4/1986 | Tabbert et al. | 5/72 |
| 4,667,354 | 5/1987 | Carey, Jr. et al. | 5/66 |

FOREIGN PATENT DOCUMENTS

| | | | |
|---|---|---|---|
| 2113433 | 6/1972 | France . | |
| 2167190 | 8/1973 | France . | |
| 166614 | 4/1981 | Netherlands | 5/70 |

*Primary Examiner*—Alexander Grosz
*Attorney, Agent, or Firm*—Mark H. Jay

[57] ABSTRACT

A patient trolley has a power-assisted tiltable backrest. The power assistance is provided by two gas spring cylinders. Advantageously, the cylinders extends through the bed of the trolley. The cylinders are released when handles are operated by a user. The handles are located at adjacent corners at the head of the trolly.

3 Claims, 3 Drawing Sheets

PATIENT TROLLEY WITH IMPROVED TILTABLE BACKREST

CROSS REFERENCE TO RELATED APPLICATION

This application is a continuation-in-part application of application Ser. No. 121,546, filed Feb. 14, 1980 now U.S. Pat. No. 4,667,354.

BACKGROUND OF THE INVENTION

The invention relates to patient trolleys, and more particularly relates to patient trolleys for use in trauma centers. In its most immediate sense, the invention relates to a patient trolley for X-raying patients who have suffered injury to the heart area of the chest.

Where an injury to the heart (e.g. a torn aeorta) is suspected, it is necessary to X-ray the mediastinum area of the patient's chest. To acquire useful information, these X-rays should be taken with the patient's upper body at approximately right angles to his lower body.

It is therefore necessary to lift the patient's upper body to accurately investigate the mediastinum area. This can be difficult, especially where the patient is obese and/or unconscious. Since speed is critical in trauma surgery, it is highly advantageous to provide a patient trolly with a power-assisted tiltable backrest. This permits e.g. a nurse or an X-ray technician to more easily move the patient into a position in which the mediastinum can be X-rayed.

In the above-referenced commonly owned pending patent appliation, there is disclosed such a patient trolley. This utilizes hydraulic cylinders which are operated by a pump to raise and lower the backrest with the patient leaning against it.

This device is awkward to use and requires a substantial number of nonstandard parts. Furthermore, it is difficult to clean. This is particularly objectionable in a patient trolley for use in trauma centers, because quantities of blood and I.V. fluids are often present.

Additionally, it is difficult for e.g. a nurse to maintain accurate control over this known device because the function of lifting is carried out by the hydraulic cylinders alone. It is therefore difficult to make relatively small adjustments to the angle of the backrest.

It is therefore one object of the invention to provide a patient trolley with a power-assisted tiltable backrest which is easier to operate than known devices.

Another object is to produce such a trolley which is easier to clean than known devices.

Still another object is to provide a patient trolley which is more compact than known patient trolleys.

Still a further object is, in general, to improve on known trolleys of this type.

SUMMARY OF THE INVENTION

In accordance with the invention, there is provided an improvement to a patient trolley of the type which has a horizontal bed and a tiltable backrest. The improvement comprises first and second like gas spring cylinders which have their first ends pivotably secured to the backrest and their second ends pivotally secured to a fixed point which is located below the bed. The improvement further comprises first and second like actuating mechanisms each connected to a corresponding one of the cylinders and releasing it when operated. The improvement further comprises first and second like operating handles which are located in one end of the bed and are operatively connected to the actuating mechanisms.

Because gas spring cylinders are used instead of hydraulic cylinders, the backrest is comparatively easy to control. This is because the cylinders are so arranged that, when actuated, they exert insufficient force to lift the backrest by themselves, and do not catapult the backrest to its upright position when actuated by an attendant.

Advantageously, the cylinders are located in slots which pass through the bed of the trolley. This produces a simple and compact apparatus which is easy to clean. Further advantageously, the handles are located at the corners of one end of the trolley and are connected together so that only one handle need be operated by the user in order to raise or lower the backrest. Further advantageously, each cylinder has an actuating plunger and this plunger is depressed by a lever in the actuating mechanism. Further advantageously, the levers are connected to the handles by flexible cables.

BRIEF DESCRIPTION OF THE DRAWINGS

Exemplary and non-limiting preferred embodiments of the invention are shown in the drawings, in which.

DETAILED DESCRIPTION OF PREFERRED EMBODIMENTS

Figure 5:
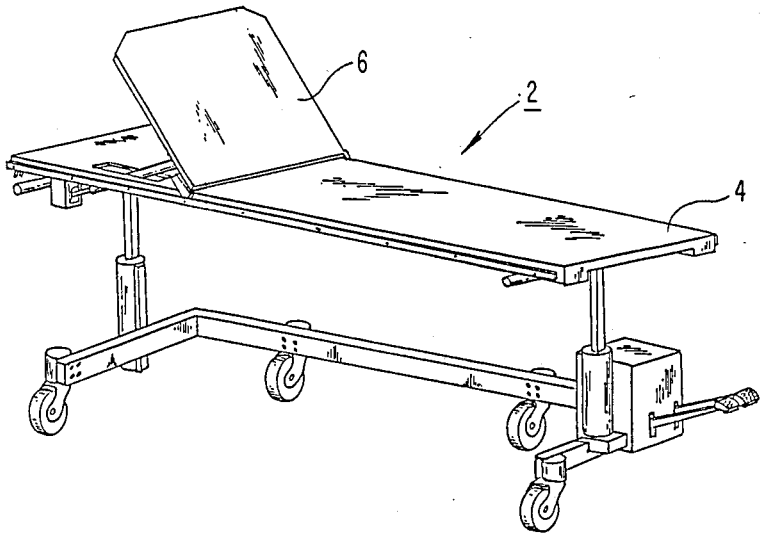
FIG. 5 is a drawing of a patient trolley incorporating the invention.
Figure 6:
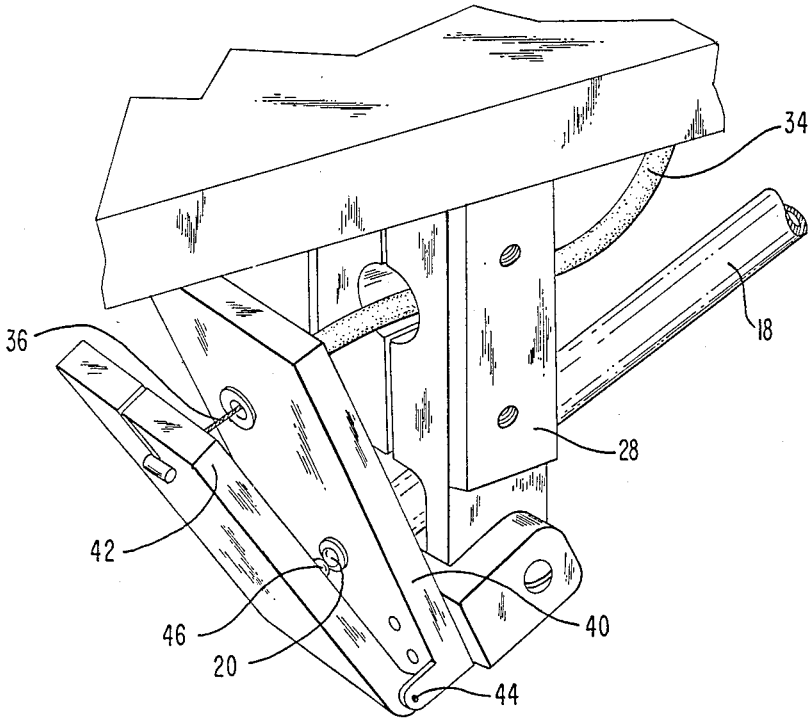
FIG. 6 is a second detailed view of a part of the preferred embodiment of the invention.

Turning first to FIG. 5, there is shown a patient trolley generally indicated by reference numeral 2. The trolley 2 has a horizontal bed 4 upon which a patient (not shown) may be placed. The patient trolley 2 is known by itself and in this preferred embodiment is a Model PTT-R patient transport trolley as sold by Siemens-Elema AB in Sweden. The bed 4 is adapted from a KOMBI tabletop manufactured by Siemens-Elema AB. The bed 4 is not fixed to the trolley 2 but can be removed therefrom for installation on, e.g. a table. (This feature is known to those skilled in the art and is not a part of the invention.)

A tiltable backrest 6 of a radiolucent material such as carbon-reinforced epoxy is physically secured to the bed 4. In this example, the backrest 6 is supported by two elongated metal flanges or brackets 8 which extend along the sides of the backrest 6 and are attached thereto as by screws 10. The brackets 8 are advantageously of stainless steel. At the lower end of each bracket 8 is located a flange 12. Flanges 12 pivotally secure the backrest 6 to the bed 4. In this example, transversely-extending horizontal posts 14 which are fixed to the bed 4 pass through holes (not shown) in the flanges 12 to provide the pivotable connection but this is not part of the invention. It is preferred because the KOMBI tabletop comes equipped with siderails 16 which are attached to the bed 4 by posts 14. (The siderails 16 are used, for example to secure, e.g. side supports, holders for drop bottles, etc. to the bed 4.)

In accordance with the invention, the backrest 6 is power-assisted by two like gas spring cylinders 18. In the preferred embodiment, these are of the type manufacutred by the Gas Spring Corporation in Colmar, Pa. While such gas spring cylinders 18 are known, it is appropriate to briefly describe their operation.

In the gas spring cylinders 18 which are used herein, the cylinder is provided with a reservoir (not shown) containing a highly pressurized volume of gas. When a plunger 20 is depressed, a valve opens and the reservoir is placed in communication with a cylinder in which a slidable piston (both not shown) is located. Thus, upon depression of the plunger 20, the cylinder 18 tends to elongate because the piston is pushed out by pressure of the gas from the reservoir. Where the plunger 20 is depressed, it is alternatively possible to compress the cylinder 18, whereupon the piston forces the gas back into the reservoir.

Figure 3:
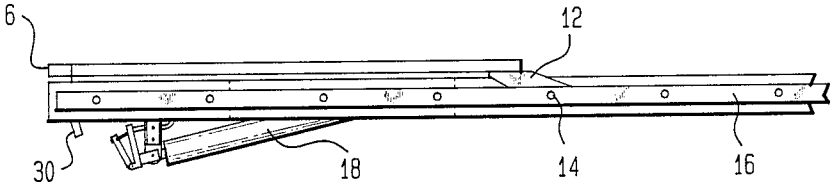
Figure 4:
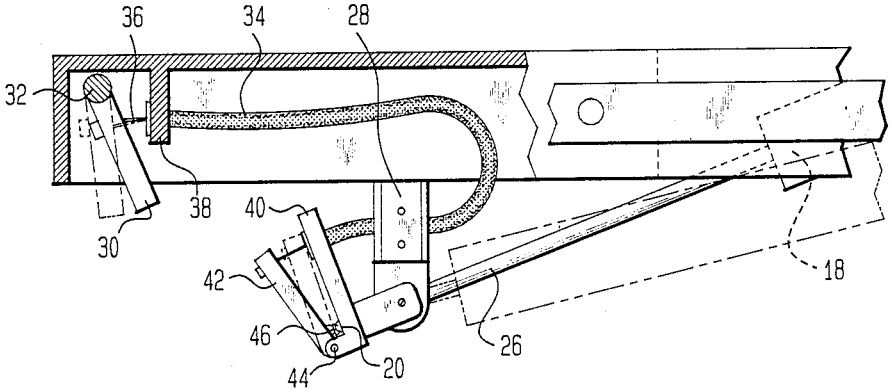
FIG. 4 is a detailed view of a part of the preferred embodiment.

Each of the cylinders 18 passes through an elongated slot 22 in the bed 4. A first end 24 of each of the cylinders 18 is pivotably secured to a corresponding one of the brackets 8 near its bottom end and the second end of each cylinder 18 is pivotably secured (by piston rod 26) to a post 28 which extends downwardly from the bed 4 adjacent its head end. As can be seen from FIGS. 2–4, when the gas spring cylinders 18 are fully extended, the backrest 6 is substantially at a right angle (actually 93°) with the bed 4, while in its most retracted position the backrest 6 is parallel to the bed 4. The small angular displacement of the cylinders 18 is accommodated by suitably dimensioning the slots 22. To operate the cylinders 18, there are provided handles 30. Advantageously, there are two handles 30 each located in one of the corners at the head of the bed 4. The handles 30 are both mounted on a shaft 32 which extends transversely across the bed 4 adjacent its head end and is mounted so as to be rotatable.

A conventional cable mechanism which includes a hollow sleeve 34 and an interior cable 36 is provided for each handle 30. One end of the sleeve 34 is fixed with respect to the bed 4 as by a flange 38. One end of the cable 36 is fixed to its corresponding handle 30. The other end of sleeve 34 is fixed to a plate 40 after passing through the post 28. The other end of the cable 36 is fixed to a lever 42 which is pivotably secured to the plate 40 as by a hinge pin 44. The lever 42 has a dimple 46 which bears against the plunger 20.

When a user pushes the bottom end of either handle 30 towards the head of the bed, both handles 30 rotate because the shaft 32 rotates. This causes the cables 36 to be pulled outwardly from the sleeves 34 and causes the levers 42 to move toward the plates 40. This depresses the plungers 20 and allows the cylinders 18 to be extended or collapsed. When the handle 30 is released, the plungers 20 are urged outwardly, separating the levers 42 from the plates 40 and returning both handles 30 to their original positions. This prevents the cylinders 18 from extending or collapsing. To make cleaning easier, the apparatus used to operate the cylinders 18 is sheathed with covers 84.

It will be understood that handles, such as handles 30, are not essential to the practice of the invention. Handles 30 were located and arranged as in the preferred embodiment because they are easy to reach but are also out of the way so that accidental operation is unlikely. Furthermore, the use of two cables 34 and the connection of the cables 34 to the handles 30 is also not essential to the invention.

Advantageously, the cylinders 18 are of the type sold under the BLOC-O-LIFT description and are filled with 240 nts of air pressure. This is just enough to slowly lift a 160 pound patient with minimal assistance from, e.g. a nurse. Thus, in the ordinary case, a nurse will be able to closely control the motion of the backrest 6 by pushing or pulling on it as appropriate. Further advantageously, the piston of each cylinder 18 is nickel-plated to prolong its useful life.

Figure 1:
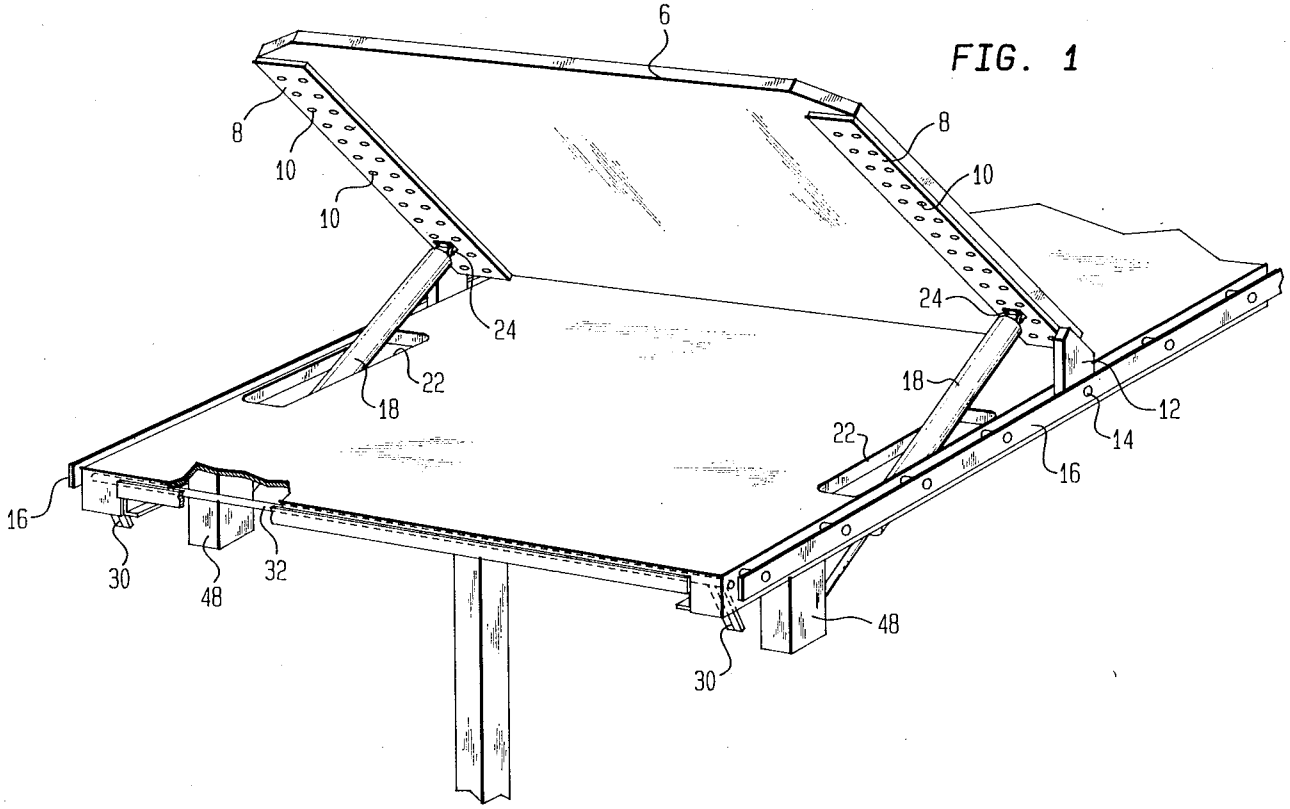
FIG. 1 is a perspective and partly schematic drawing of a preferred embodiment of the invention.
Figure 2:
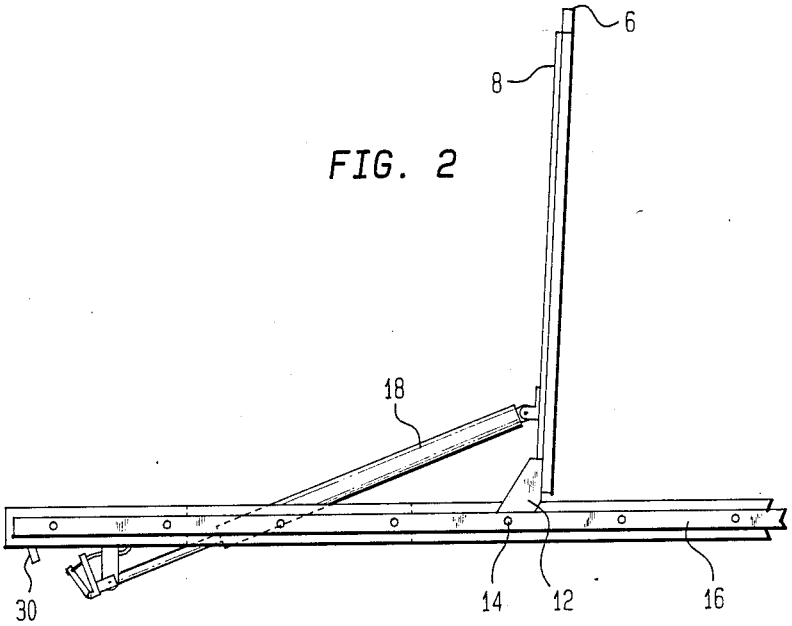
FIGS. 2 and 3 show the preferred embodiment in its two extreme positions.

In use, a patient placed on the bed 4 and the backrest 6 is lifted to the position shown in FIG. 2. This permits the mediastinum to be X-rayed. Thereafter, the backrest 6 can be lowered to the position shown in FIG. 3 and the patient may be removed from the bed 4.

Those skilled in the art will understand that changes can be made in the preferred embodiments here described, and that these embodiments can be used for other purposes. Such changes and uses are within the scope of the invention, which is limited only by the claims which follow.

What is claimed is:

1. An improvement to a patient trolley of the type which has a horizontal bed and a tiltable backrest which is pivotable between a first position in which the backrest is parallel to the bed and a second position in which the backrest is at approximately right angles with respect to the bed, the improvement comprising:

first and second like gas spring cylinders each having first and second ends, the first ends of each of the gas spring cylinders being pivotably secured to the backrest and the second ends of each of the gas spring cylinders each having an actuating plunger and being pivotably secured to a fixed point which is located below the bed;

first and second like actuating mechanisms, each operatively connected to a corresponding one of the cylinders to release the cylinder when operated by a user and comprising a lever which depresses said plunger when the mechanism is operated; and operating means located in one end of the bed and operatively connected to the actuating mechanisms, said operating means comprising first and second like handles which are mounted to a rotatable shaft, each handle being connected to its corresponding lever by a flexible cable.

2. The improvement of claim 1, wherein the bed has two parallel and elongated slots through which the cylinders pass.

3. The improvement of claim 1, wherein the backrest is at 93° with respect to the bed when the backrest is in the second position.

* * * * *